US007453772B2

(12) United States Patent
Porzio

(10) Patent No.: US 7,453,772 B2
(45) Date of Patent: Nov. 18, 2008

(54) FLEXURAL CYLINDER PROJECTOR

(75) Inventor: Raymond Porzio, LaFayette, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 205 days.

(21) Appl. No.: 11/269,912

(22) Filed: Nov. 8, 2005

(65) Prior Publication Data

US 2007/0206441 A1 Sep. 6, 2007

Related U.S. Application Data

(60) Provisional application No. 60/626,032, filed on Nov. 8, 2004.

(51) Int. Cl.
*G10K 9/12* (2006.01)
*H04R 17/00* (2006.01)

(52) U.S. Cl. ..... 367/174; 367/163

(58) Field of Classification Search ..... 367/163, 367/174; 310/337

See application file for complete search history.

(56) References Cited

U.S. PATENT DOCUMENTS 3,258,738 A 6/1966 Merchant
4,409,681 A * 10/1983 White ..... 367/166
4,706,230 A * 11/1987 Inoue et al. ..... 367/174
4,845,688 A 7/1989 Butler
5,694,374 A 12/1997 Ripoll et al.
6,298,012 B1 10/2001 Benjamin
6,400,649 B2 6/2002 Skinner et al.
6,643,222 B2 11/2003 Osborn et al.
6,711,097 B1 * 3/2004 Engdahl ..... 367/174

OTHER PUBLICATIONS

International Search Report dated Nov. 20, 2006 for related PCT Application No. PCT/US05/40435.

* cited by examiner

*Primary Examiner*—Ian J Lobo
(74) *Attorney, Agent, or Firm*—Howard IP Law Group, PC

(57) ABSTRACT

An inverse flextensional projector exhibits a low frequency flexural mode and a higher frequency "breathing" mode to defeat stealthy targets and to conduct short and long range detection and tracking in littoral waters. The device has much broader bandwidth than conventional flextensional transducers, slotted cylinders and conventional cylinder transducers. The device has a low frequency capability similar to slotted cylinder projectors (SCP) but is broader band and does not suffer from the unsupported gap of SCP projectors. The invention has a more uniform radiation velocity than both SCP and flextensional transducers, making it much less susceptible to cavitation limitations.

31 Claims, 8 Drawing Sheets

FLEXURAL CYLINDER PROJECTOR

RELATED APPLICATION

This application claims priority to U.S. Provisional Application No. 60/626,032, filed Nov. 8, 2004, the subject matter thereof incorporated by reference herein in its entirety.

FIELD OF THE INVENTION

The invention in general relates to transducer devices, and more particularly, to a flextensional transducer device.

BACKGROUND OF THE INVENTION

Electroacoustical transducers are advantageous because they provide a conversion between electrical energy and acoustical energy. For example, when alternating current signals are introduced to an electroacoustical transducer, the transducer vibrates and produces acoustical energy in accordance with such vibrations. The conversion of electrical energy to acoustical energy has a number of different uses such as in loud speakers and in sonar applications, for example.

Piezoelectric elements, primarily crystals and ceramics, are employed in a variety of devices including crystal microphones, ultrasonic devices, accelerometers and oscillators. One of the most common uses of piezoelectric elements is in underwater sonar equipment in which a piezoelectric sonar transducer is stimulated by electrical signals to emit sonar signals which radiate out from the transducer. The sonar signals are reflected off of underwater objects and the reflected signals are then detected by the transducer, which in turn produces and delivers electrical signals carrying information about the underwater object.

Flextensional sonar transducers of the prior art may employ a stack of piezoelectric transducer elements interspersed with electrically conducting plates for stressing the elements and for picking up electrical current produced by the elements; a prestressed compression band, made for example of a filament wound material, wrapped about the piezoelectric stack; and an outer elliptically-shaped shell wrapped about the compression band. The stack of piezoelectric elements generally extends along the major axis of the ellipse defined by the outer shell. When an alternating voltage is applied to the conducting plates, the stack of piezoelectric elements is caused to be displaced in the direction of the major axis in proportion to the instantaneous value of the voltage. The vibration and displacement of the stack is transmitted to the shell which amplifies the vibration along the minor axis of the ellipse to produce the sonar signals. That is, as the stack expands to expand the major axis of the ellipse, the long walls of the ellipse perpendicular to its minor axis contract, and as the stack contracts to expand the long walls of the ellipse, vibration of the shell necessary to generate the sonar is produced. In an alternative arrangement of a flextensional transducer, a magnetostrictive element may replace the piezoelectric stack.

The elliptical shells used in flextensional transducers are typically preformed of filament-wound composites such as glass, reinforced plastic or aluminum. In order to incorporate the stack of piezoelectric elements in the shell, the shell is compressed along its minor axis by means of a press, and the piezoelectric stack is inserted into the shell to coincide with the major axis. Upon removal of the compressive force from along the minor axis, a residual force remains in the shell to retain the stack and apply a predetermined compressive stress thereto. Construction of the assembly in this fashion requires the piezoelectric stack and elliptical shell be prepared to close tolerances both to allow for easy insertion of the stack within the compressed shell, and to retain tight contact between the stack and the shell upon removal of the compressive forces.

Slotted Cylinder Projectors or SCPs, have been used to provide low frequency transducer devices capable of operating in the low frequency range (about 425 Hz and below). More particularly, compact SCPs having diameters less than or equal to T-size (i.e. 12.75 inch outer diameter) have been used for such low frequency range operation. However, these SCPs exhibit a very narrow bandwidth which limits the breadth of operation of such devices. In addition, high power SCPs require a great number of segmented 33-mode rings, each of which is formed from multiple wedges. This causes difficulty in both the initial manufacturing process (which is very labor intensive), as well as in the prestress portion and installation into the inert shell. Furthermore, such SCPs exhibit reliability problems resulting from the unsupported gap or slot therein. FIG. 1 is an illustration of a prior art transducer device 10 having an inert tubular member 12 with a gap 14 and a plurality of sectionalized transducer elements 16 arrayed within the member 12 in abutting and progressive relationship to one another and in abutting relationship to the inner wall of the member 12. The gap is typically covered with a thin boot to avoid suppressing motion. The unsupported gap causes high stress risers in the ceramic which results in ceramic failure and flooding failure into the gap region. Moreover, the high velocity near the gap region often results in undesirable cavitation. A cylindrical transducer which overcomes one or more of the aforementioned difficulties is highly desirable.

SUMMARY OF THE INVENTION

In accordance with an aspect of the present invention, there is described an inverse flextensional projector having a low frequency flexural mode and a higher frequency "breathing" mode. The device has much broader bandwidth than conventional flextensional transducers, slotted cylinders and conventional cylinder transducers. The device has a low frequency capability similar to slotted cylinder projectors (SCP) but is broader band and does not suffer from the unsupported gap of SCP projectors. The present invention provides for a more uniform radiation velocity than both SCP and conventional flextensional transducers, making it much less susceptible to cavitation limitations.

According to an aspect of the present invention, a flextensional apparatus for use in a flextensional transducer comprises a shell having an internal hollow bounded at a top surface and a bottom surface by a concavo-concave arm arrangement, each arm having a first and second end and each of a given thickness, with the top concave arm and the bottom concavo arm joined at the first end by a common thicker first end portion and each arm joined at the second end by corresponding common thicker second end portion. A plurality of vibratable elements are arranged in a stack from a first end to a second end, the stack positioned in the hollow of the shell and extending from one end of the hollow to the other end and positioned along an axis such that the first and second arms are symmetrically disposed with respect to the axis. A first radiator extends in a first direction relatively from the center of the first arm and is operably coupled thereto, and a second radiator extends in an opposite direction from the center of the second arm and is operably coupled thereto, whereby when the elements vibrate, the arms deform to cause the radiators to alter position according to the deformation.

According to another aspect, a flextensional transducer comprises a drive assembly comprising a stack of one or more vibratable elements responsive to an alternating power source; a flextensional shell having an internal hollow for accommodating the drive assembly, the shell having first and second bulbous end portions, each adapted to receive a corresponding end of the drive assembly, and a concavo-concave arm arrangement, each arm having a first and second end terminating at a respective one of the bulbous end portions, thereby defining the hollow; a first radiator extending in a first direction relatively from the center of the first arm and operably coupled thereto, and a second radiator extending in an opposite direction relatively from the center of the second arm and operably coupled thereto, whereby when the elements vibrate, the arms deform to cause the first and second radiators to alter position according to the deformation.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and.

DETAILED DESCRIPTION

It is to be understood that the figures and descriptions of the present invention have been simplified to illustrate elements that are relevant for a clear understanding, while eliminating, for the purpose of clarity, many other elements found in typical slotted cylinder transducers and drive assemblies and methods of making and using the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

Figure 1:
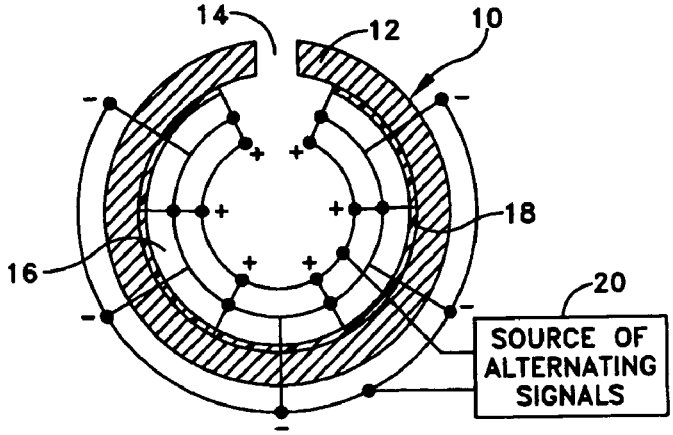
FIG. 1 (PRIOR ART)
FIG. 1 illustrates a view of a prior art transducer.
Figure 2A:
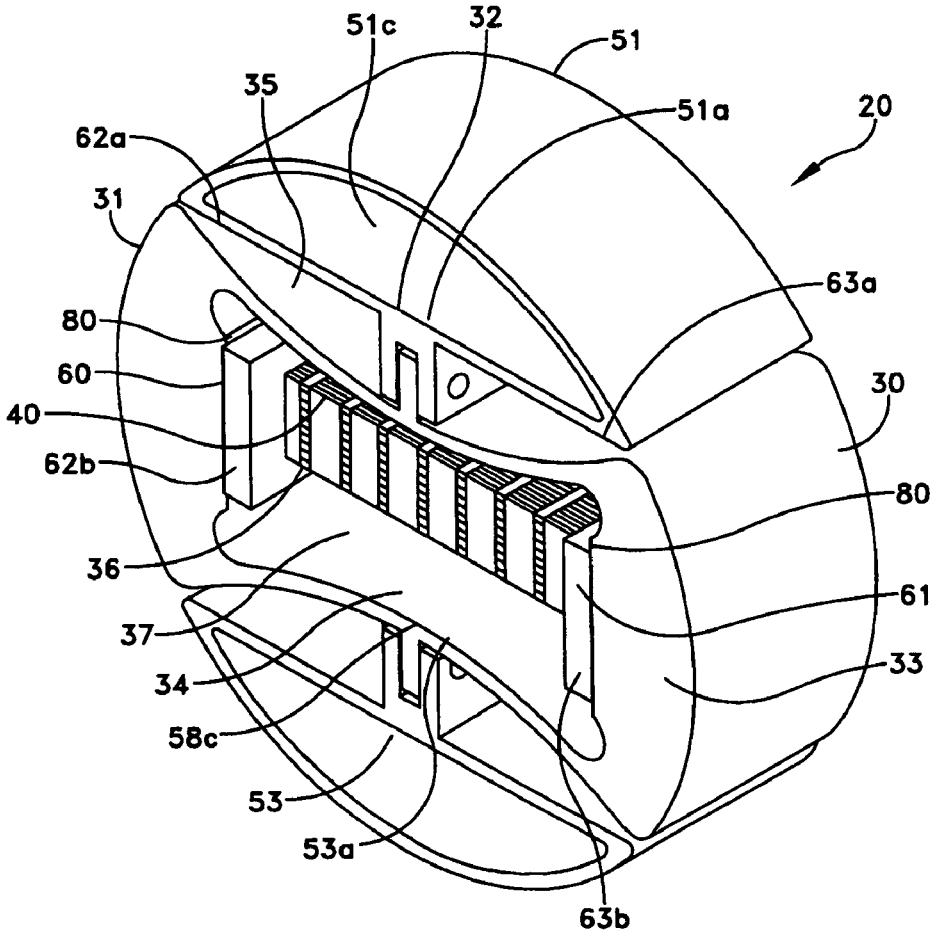
FIG. 2A is a schematic perspective view of a flexural cylindrical projector transducer having a flextensional shell and radiator structure according to an embodiment of the invention.
Figure 2B:
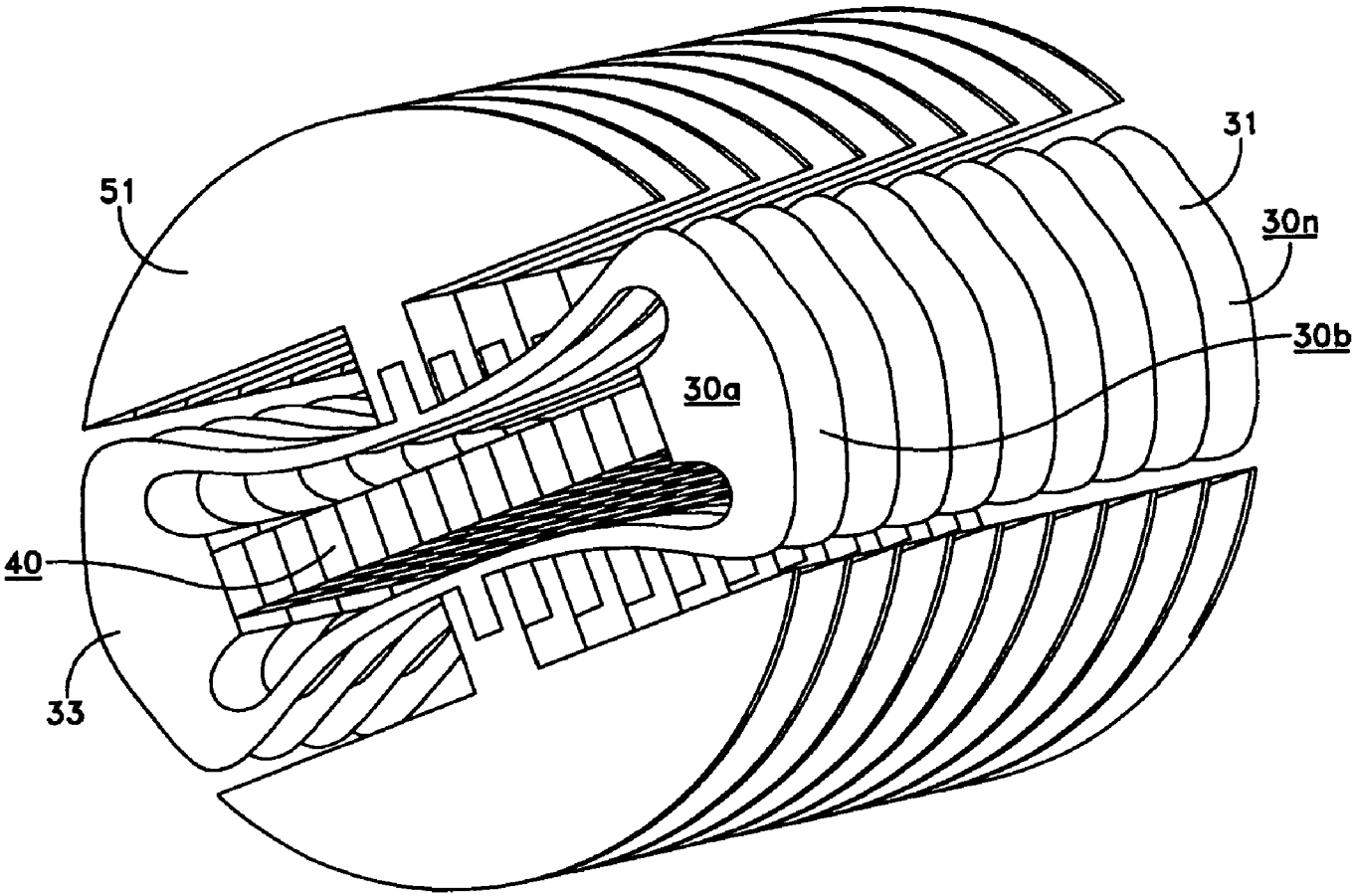
FIG. 2B is a schematic perspective view of a flexural cylindrical projector transducer comprising concatenated sets of flextensional shell and radiator structures according to an embodiment of the invention.

Referring now generally to FIG. 2A, there is shown a flextensional cylindrical projector transducer 20 comprising an inverse, flextensional shell structure 30 coupled to a pair of oppositely disposed radiators 51, 53, for producing vibrational motion in response to a source of alternating signals applied to a drive assembly 40 positioned within flextensional shell 30. In the configuration depicted in FIG. 2A, the transducer 20 may comprise a single shell 30 (and corresponding radiator shells 51, 53), or alternatively, may include a plurality of flextensional shells 30*a*, 30*b*, . . . , 30*n* arranged in a stacked fashion and operably coupled to enable vibratory motion in response to a source of electrical signals, as depicted in FIG. 2B. Throughout the drawings, like reference numerals are used to indicate like parts. As illustrated in FIG. 2A, the shell structure 30 comprises first and second end portions 31, 33 integrally coupled with inwardly shaped (concave) arcuate central arm members 35 and 37 which are oppositely disposed with respect to one another. End portions 31, 33 are generally bulbous relative to the thinned central arm members 35, 37. The inverse flextensional shell structure 30 includes a central portion 36 which is hollow and is bounded by the concavo-concave arm members 35 and 37, which extend to the thicker end portions 31 and 33. The hollow of the shell is configured to receive a drive assembly 40 such as a ceramic or magnetostrictive stack positioned therein and retained at first and second sides 60 and 61. Each of sides 60, 61 includes a substantially planar central portion that terminates in arcuate extending portions 62*a*, 62*b*, and 63*a*, 63*b*, respectively, at opposing sides of the inner wall of the shell 30 within the hollow.

Figure 2D:
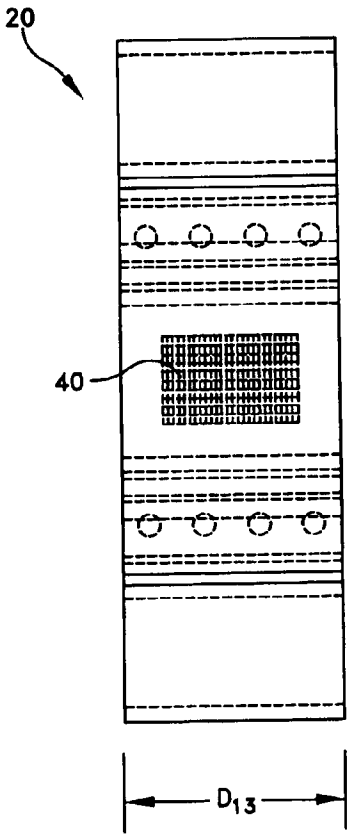
FIGS. 2C-2D are schematic plan and side sectional views, respectively, of the transducer structure of FIG. 2A.
Figure 2C:
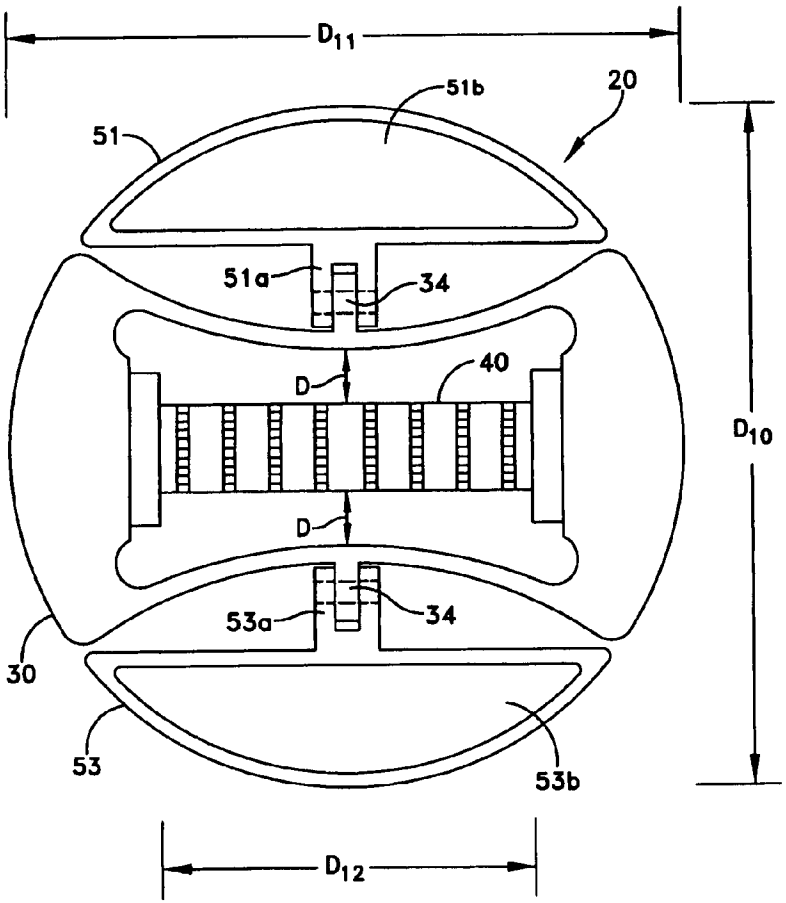
Figure 2E:
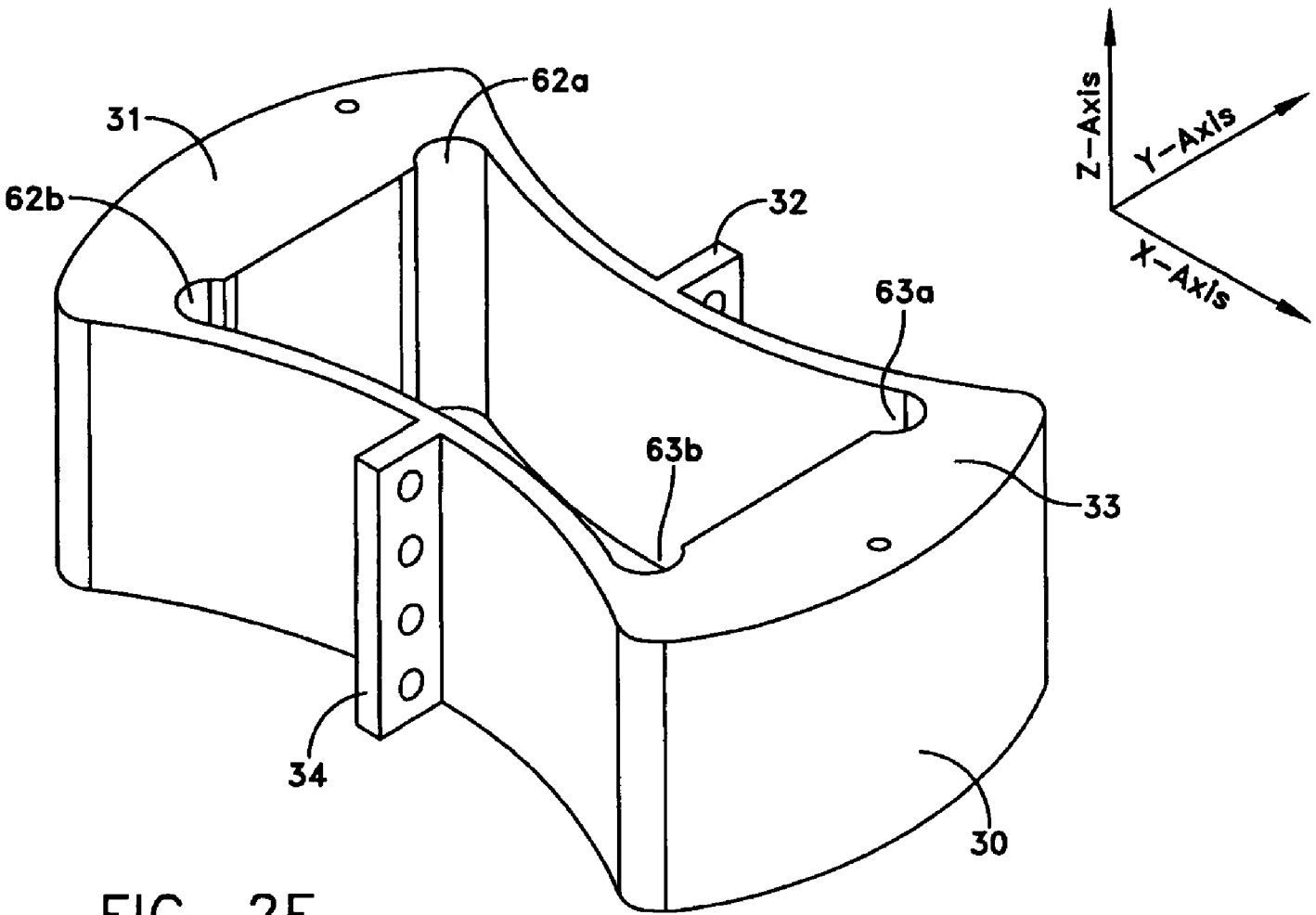
FIG. 2E is a schematic perspective view showing the flextensional shell of FIG. 2A.
Figure 3:
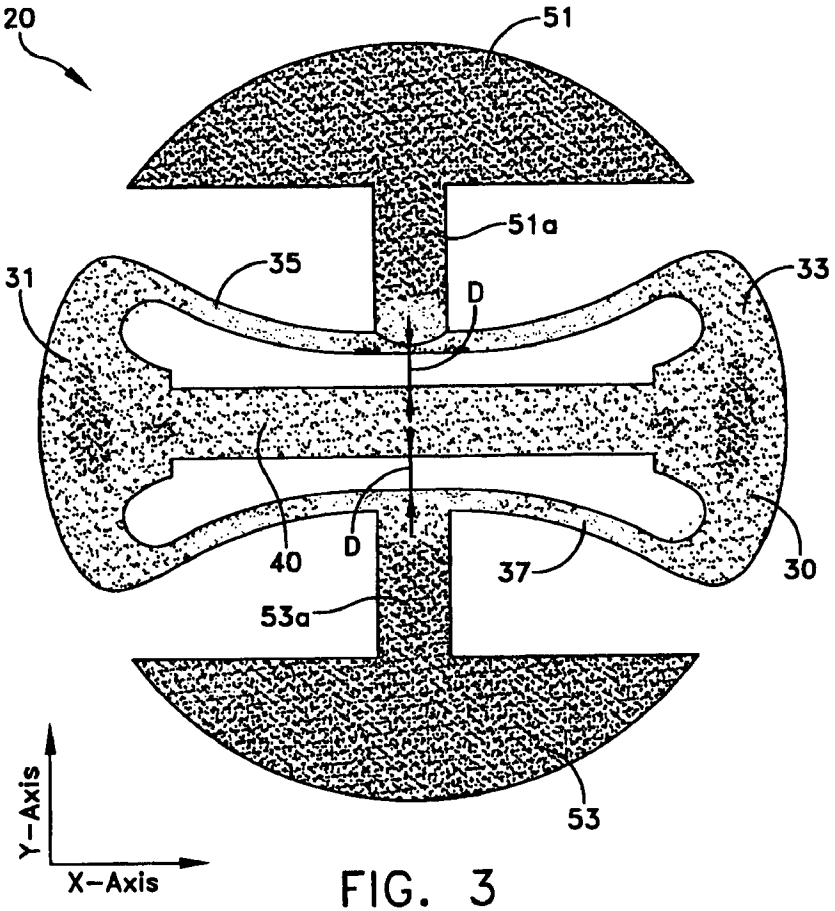
FIG. 3 is a schematic cross sectional view of a flexural cylindrical projector transducer according to an embodiment of the invention illustrating the shape of the device in an inactive or undeformed condition.

Referring now to FIG. 2A in conjunction with FIG. 2E and FIG. 3, the shell in an inactive or undeformed state resembles a hollow "dogbone" configuration. For the shell structure 30, the flextensional cylindrical projector transducer includes a drive assembly comprising stack 40 of ceramic or magnetostrictive elements or crystals laid out in a linear array, with electrodes disposed between the elements. In an exemplary configuration, a magnetostrictive drive assembly may comprise one or more drive rods and biasing magnet surrounded by a drive coil subassembly of a substantially rectangular configuration, the magnetostrictive drive stack operably coupled between the first and second sides 60, 61 of respective end portions 31, 33. The drive assembly may be coupled via one or more acoustic backing/matching layers 80. The drive rod(s) may be formed of a material such as terbium dysprosium iron or Terfenol (e.g. Terfenol-D) and biasing magnet formed of a samarium cobalt material, for example. The shell structure 30 is preferably fabricated from a metal such as a high tensile strength, non-magnetic steel. Conductors carry electrical signals to the electrodes to stress the elements and cause them to vibrate along the axis of the stack 40. The conductors also carry electrical signals produced by the stack 40 of piezoelectric elements when the elements intercept sonar signals, all in a well-known manner.

Figure 4:
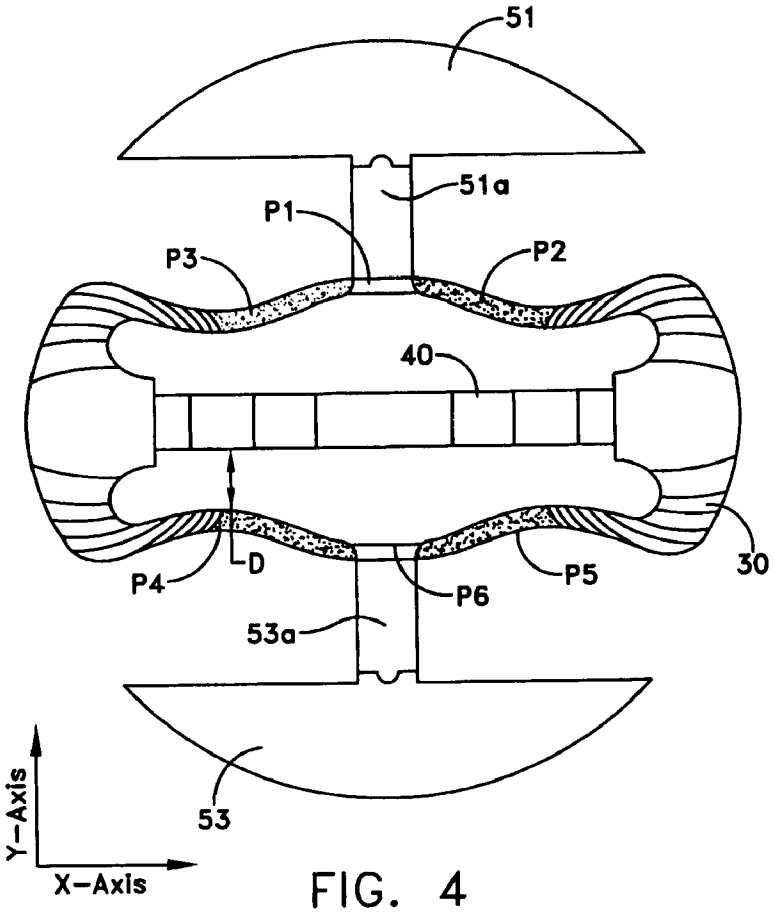
FIG. 4 is a schematic cross sectional view of a flexural cylindrical projector transducer according to an embodiment of the invention illustrating the shape of the device in an active or deformed condition.

End portions 31 and 33 located at respective ends of the stack 40 are intimately coupled therewith. The end portions, together with arm members 35, 37 form a closed loop about stack 40. The arm members are configured in symmetrical fashion and form an arcuate shape such that, in an inactive or undeformed position, the arms of the shell 30 extend in an inverse, arcuate manner toward the stack such that the distance D between the arm members and the stack is minimized at substantially the center or midpoint P of the stack, which is the midpoint of the transducer structure (see FIG. 2C). When alternating current signals are introduced to the sectionalized elements of the stack, the elements vibrate and produce vibrations in the shell at positions adjacent to the end portions, which cause flexure of the arm members in a direction normal to axis A as illustrated in FIGS. 3-4, such that each of the concavo-concave arms deform to a convexo-convex segment at the center or midpoint of the arm members, with adjacent concave segments offset from the midpoint along the arms and symmetrically oriented. The thickness and dimensions of the shell, including the varying thickness of the arm members and end portions, are selected to produce the vibrations at one or more preselected frequencies, such as in the 400 Hz-400 KHz range, by way of non-limiting example only.

Referring now to FIG. 2A in conjunction with FIGS. 2C-2G, the inverse, flextensional shell 30 is monolithically formed and retained within the cylindrical projector 20 by oppositely disposed and symmetrically configured radiating shell structures 51, 53, each having a mushroom or T-shaped configuration. Planar support members 51*a*, 53*a* extend from a bulbous head segment 51*b*, 53*b* for radiating in response to vibration of the ceramic or magnetostrictive stack 40 and subsequent flexure of flextensional shell 30. Each radiating shell 51, 53 is preferably formed of a low density, high stiffness material such as a lightweight composite or plastic radiator. The top radiator shell portion 51 and bottom radiator shell portion 53 are symmetrically configured and oriented to accommodate the inverse flextensional shell 30. Flextensional shell 30 includes corresponding tab projections 32, 34 extending outward in a substantially normal direction from the center of respective arm members 35, 37, and along the entire longitudinal surface (z-axis) of shell 30 (FIG. 2E). Each tab portion 32, 34 is received in a corresponding aperture 51*c*, 53*c* (FIG. 2A) associated with support members 51*a* and 53*a* which extend from the top 51 and bottom 53 radiators, respectively, and abut the central portion of shell 30. In this manner, the support members 51*a*, 53*a* receive the corresponding tab portions 32, 34 of arm members 35, 37 via the corresponding apertures or notches to provide for flexural response. It is also to be understood that each mushroom shaped radiator may be operably configured in a stacked manner to form the projector transducer as illustrated in FIG. 2B.

Figure 2F:
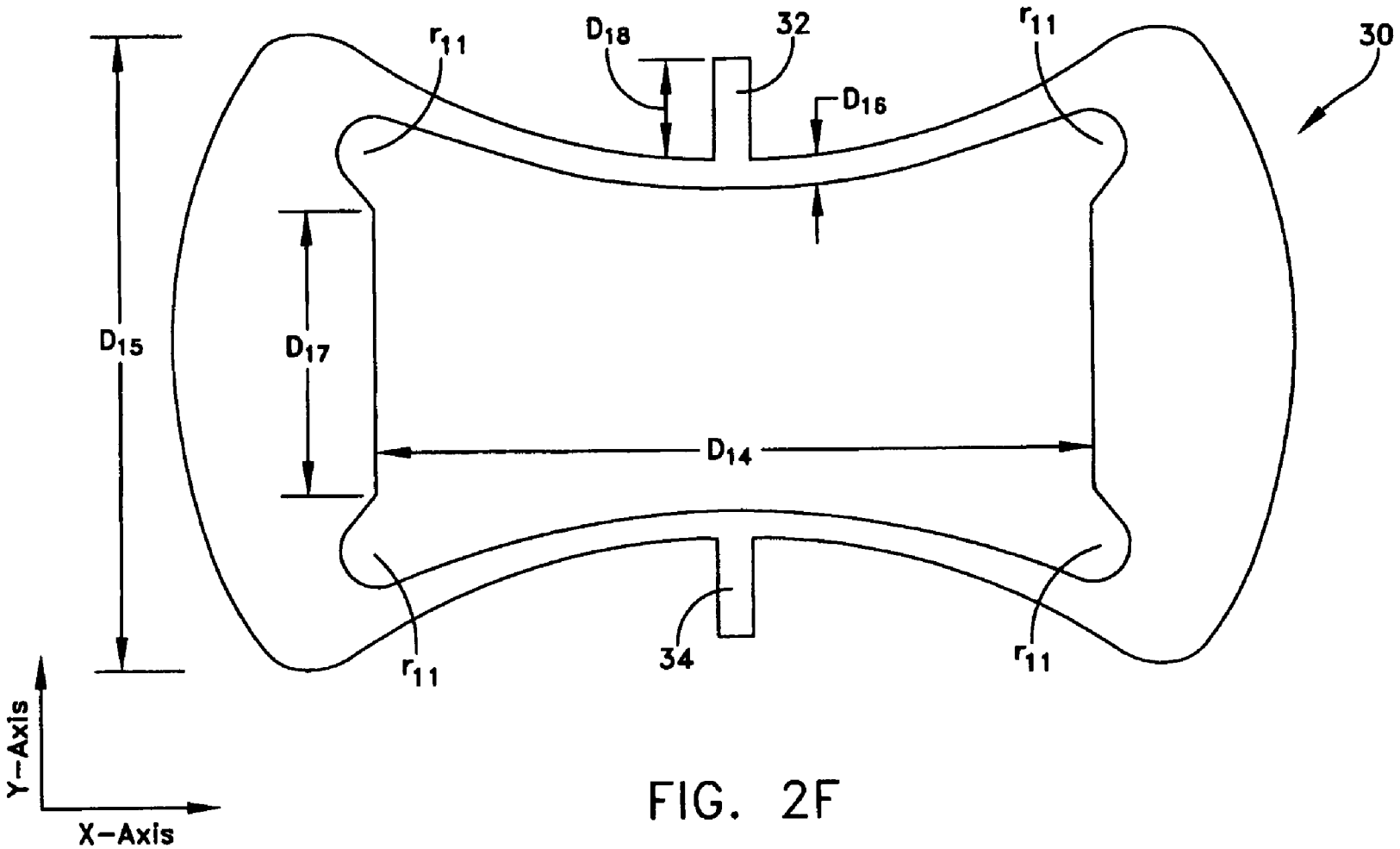
FIG. 2F is a schematic plan view of the flextensional shell of FIG. 2A.
Figure 2G:
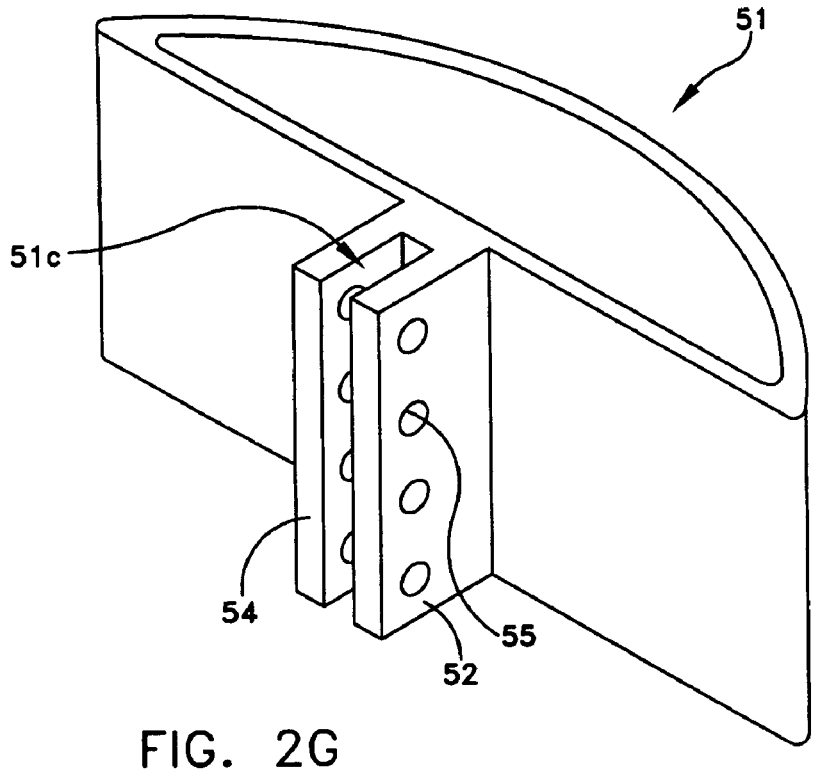
FIGS. 2G-2H are schematic perspective and side views, respectively, of one of the radiator shells of FIG. 2A.
Figure 2H:
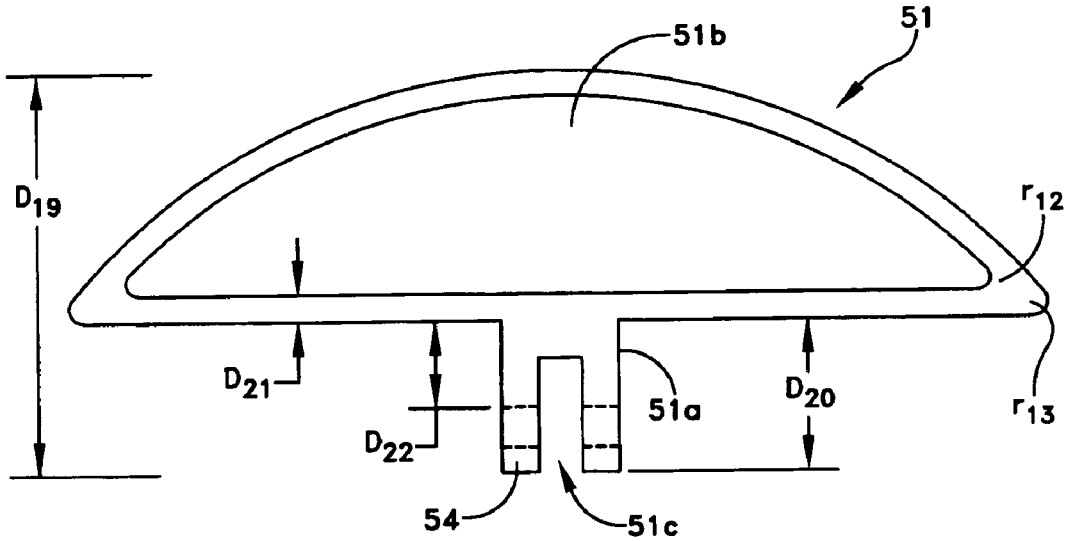

FIGS. 2G-2H provide a more detailed view of one of the mushroom or T-Shaped radiators 51 according to an exemplary embodiment of the present invention. As shown therein, the support member 51*a* is configured to have planar sides 52, 54 defining an aperture or channel 51*c* there between for accommodating the corresponding tab portion of shell 30 (not shown). One or more through holes 55 may be formed in each of sides 52 and 54 and aligned with corresponding holes formed in the flextensional shell tab portions so as to operably couple thereto using various fastening or securing means, including but not limited to rivets, bolts, screws, welds, adhesives or other fastening mechanisms. The various dimensions and geometries associated with the radiator and flextensional shell structures are a function of the particular application and may be influenced by various characteristics, including frequency (e.g. resonant frequency), bandwidth, coupling efficiencies, and the like. It is understood that the geometry associated with the transducer and flextensional shell and radiator assembly of the present invention may be symmetrical about the x and y axes, as depicted in the embodiments illustrated in FIG. 2. In a particular embodiment, the transducer comprises a magnetostrictive stack arrangement with flextensional shell and radiator structures having the following dimensions (in inches) with reference to the drawings: $D_{10}$=12.5; $D_{11}$=12.5; $D_{12}$=6.84 (FIG. 2C); $D_{13}$=4.0 (FIG. 2D); $D_{14}$=8.0; $D_{15}$=7.0; $D_{16}$=0.3; $D_{17}$=3.6; $D_{18}$=1.1; radius $R_{11}$=0.45; (FIG. 2F); $D_{19}$=2.5; $D_{20}$=1.55; $D_{21}$=0.25; radius $R_{12}$=0.12; $R_{13}$=0.12 (FIG. 2H). The above dimensions represent merely one embodiment of the present invention and are provided for non-limiting purposes of explanation only.

FIGS. 3 and 4 illustrate various shapes associated with the cylindrical flextensional projector in both the inactive or undeformed shape (FIG. 3) and the active or deformed shape (FIG. 4). As shown, the inactive mode exhibits a minimum distance D from the center of the stack (and hence minimum radiator shell displacement). The arms 35 and 37 in the inactive state are in a concave-concavo arrangement. As seen, the concave upper arm 35 and the concavo lower arm 37 are joined at their first and second ends by the thicker end portions 31 and 32. The stack 40 is symmetrically disposed between the arms 35 and 37 and there is symmetry of the unit about axis x (and y). The stack 40 is positioned at a center axis within the hollow of the shell 30. The arms 35 and 37 are symmetrically disposed about that axis. In the active mode, the arm members are in flexure such that different segments of the arm members are now closer to the stack 40 (i.e. P2, P3, P4, P5 in FIG. 4) while the central portion of each arm is now further away from the stack (i.e. P1, P6). This in turn causes the central portions of the flextensional shell to urge against respective support members 52, 54 to move each of the corresponding radiator shells 51, 53 in order to radiate acoustic energy from the projector device. As shown in FIG. 4, the central portions of the arms symmetrically deform to cause them to assume during the active state a convexo-convex configuration. The radiating members 51 and 53 coupled to the center of arms 35 and 37 by support members 52 and 53 move accordingly. It is understood that the deflection of the arms is a function of the magnitude of vibration and hence an infinite number of positions between the inactive (FIG. 3) and active states (FIG. 4) can be accommodated.

Figure 5:
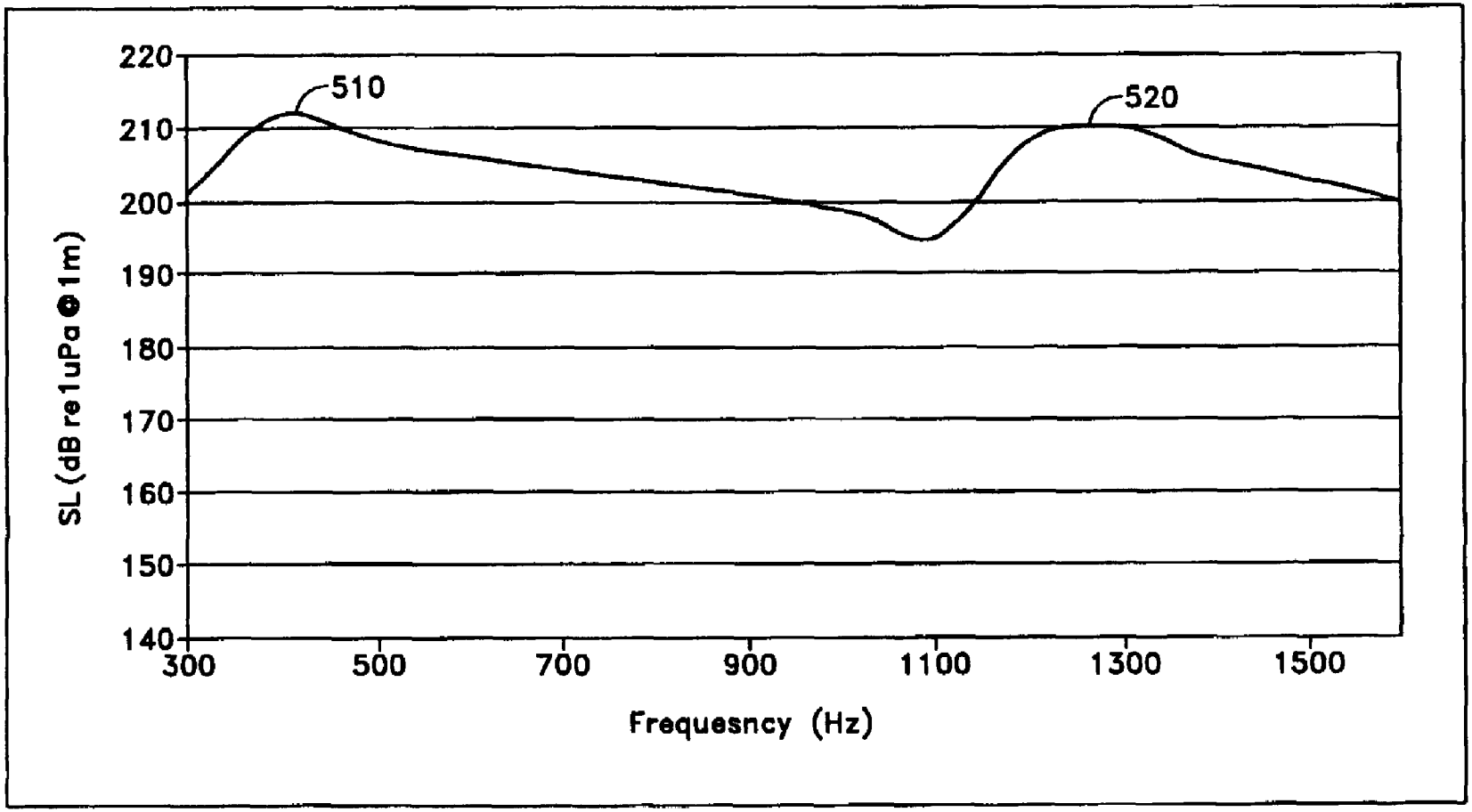
FIG. 5 is a graph illustrating the first and second modes of operation associated with the flexural cylindrical projector transducer according to an aspect of the invention.

Referring now to the graphical illustration of FIG. 5, the projector 20 according to an aspect of the present invention is operative in a first fundamental vibration mode (i.e. flexural mode) and in a second vibration mode (i.e. breathing mode). For a 12.75 outer diameter, 24 inch length projector device 20, the first mode 510 operates at about 425 Hz, while the second mode 520 operates at about 1300 Hz. The present invention thus provides substantially greater bandwidth than current transducer devices while providing an additional higher band at a center frequency of 2.5 times higher than the fundamental vibration mode.

The flextensional cylindrical projector of the present invention thus provides for a low frequency multi-band, transducer which is essentially omnidirectional and which provides greater flexibility for multiple environments. The present transducer structure is devoid of the stress and reliability concerns associated with conventional SCP devices while providing a low frequency projector at significantly lower cost than SCPs currently in use.

Those of ordinary skill in the art may recognize that many modifications and variations of the present invention may be implemented without departing from the spirit or scope of the invention.

What is claimed is:

1. A flextensional apparatus for use in a flextensional transducer, comprising:

a shell having an internal hollow bounded at a top surface and a bottom surface by a concavo—concave arm arrangement, each arm having a first and second end and each of a given thickness, with the top concave arm and the bottom concavo arm joined at the first end by a common thicker first end portion and each arm joined at the second end by corresponding common thicker second end portion;

a plurality of vibratable elements arranged in a stack from a first end to a second end, said stack positioned in the hollow of said shell and extending from one end of the hollow to the other end and positioned along an axis such that said first and second arms are symmetrically disposed with respect to said axis;

a first radiator extending in a first direction relatively from the center of said first arm and operably coupled thereto, and a second radiator extending in an opposite direction from the center of said second arm and operably coupled thereto, whereby when said elements vibrate, said arms deform to cause said radiators to alter position according to said deformation, and wherein said first radiator and said second radiator each have a symmetrical mushroom configuration.

2. The apparatus according to claim 1, wherein said shell is formed from a high strength metal.

3. The apparatus according to claim 2, wherein said metal is a high strength, non-magnetic steel.

4. The apparatus according to claim 1, wherein said stack of vibratable elements are ceramic elements.

5. The apparatus according to claim 1, wherein said stack of vibratable elements are magnetostrictive elements.

6. The apparatus according to claim 1, wherein each arm comprises a tab positioned relatively at the center of said arm and extending in a direction normal to the surface of said arm for operably coupling to a corresponding one of said radiators.

7. The apparatus according to claim 6, wherein each radiator comprises a channel for receiving said tab.

8. The apparatus according to claim 1, wherein said radiators are of a T shaped configuration.

9. The apparatus according to claim 1, wherein said radiators are formed from a low density, high stiffness material.

10. The apparatus according to claim 9, wherein said radiator material is a light weight plastic.

11. The apparatus according to claim 1, wherein said flextensional transducer comprises a plurality of said flextensional shells arranged in a stacked configuration along a common axis from a first to a second end.

12. The apparatus according to claim 1, wherein said flextensional apparatus can operate in a first or second vibration mode.

13. The apparatus according to claim 12, wherein said first mode is a flextensional mode.

14. The apparatus according to claim 13, wherein said second mode is a breathing mode.

15. The apparatus according to claim 1, wherein the thickness and dimensions of the shell are selected to produce vibrations in the range between 400 Hz to 400 KHz.

16. The apparatus according to claim 1, wherein said flextensional shell is monolithically formed.

17. The apparatus according to claim 1, wherein said stack of vibratable elements includes means for applying operating potential to said elements to cause said elements to vibrate.

18. The apparatus according to claim 17, wherein said means are operative to provide electrical signals when said stack is vibrated by acoustical waves.

19. A flextensional transducer comprising:

a drive assembly comprising a stack of one or more vibratable elements responsive to an alternating power source;

a flextensional shell having an internal hollow for accommodating said drive assembly, said shell having first and second bulbous end portions, each adapted to receive a corresponding end of the drive assembly, and a concavo-concave arm arrangement, each arm having a first and second end terminating at a respective one of said bulbous end portions, thereby defining said hollow, and a first radiator extending in a first direction relatively from the center of said first arm and operably coupled thereto, and a second radiator extending in an opposite direction relatively from the center of said second arm and operably coupled thereto, wherein said first radiator and said second radiator each have a symmetrical mushroom configuration, whereby when said elements vibrate, said arms deform to cause said first and second radiators to alter position according to said deformation.

20. The flextensional transducer of claim 19, wherein said transducer is operable in a first flextensional mode associated with a first relatively operating frequency and a second breathing mode associated with a second relatively high operating frequency.

21. The flextensional transducer of claim 20, wherein each arm comprises a projecting tab positioned relatively at the center of said arm and extending in a direction normal to the surface of said arm for operably coupling to a corresponding one of said radiators.

22. The flextensional transducer of claim 21, wherein each radiator comprises a channel for receiving said corresponding tab.

23. The flextensional transducer of claim 22, further comprising means for fastening each of said first and second radiators to a respective one of said arms via the corresponding channel and tab.

24. A flextensional apparatus for use in a flextensional transducer, comprising:

a shell having an internal hollow bounded at a top surface and a bottom surface by a concavo—concave arm arrangement, each arm having a first and second end and each of a given thickness, with the top concave arm and the bottom concavo arm joined at the first end by a common thicker first end portion and each arm joined at the second end by corresponding common thicker second end portion; and a pair of projecting tabs extending from substantially the midpoint of each of the concavo and concave arms in opposite direction along a longitudinal axis thereof, each tab adapted for engaging a corresponding radiator to generate vibrational motion in response to deformation of said shell.

25. The flextensional apparatus of claim 24, wherein each tab is insertable into a corresponding channel of a T-shaped radiator.

26. The flextensional apparatus of claim 25, wherein each tab includes a plurality of through holes for alignment with corresponding through holes in sides defining the corresponding channel of said T-shaped radiator.

27. The flextensional apparatus of claim 24, wherein a stack of vibratory elements are disposed within the hollow of said shell and operably coupled to said first and second thicker end portions, and wherein each of the arms of said shell deform to a convex section at the midpoint of said arm, and concave sections at adjacent portions along said arm, in response to biasing said vibratory elements.

28. The apparatus according to claim 1, wherein each of said radiators comprises a planar support portion and a bulbous head segment.

29. The apparatus according to claim 28, wherein said bulbous head segments comprise hollow shells.

30. The apparatus according to claim 28, wherein said bulbous head segments extend substantially the length of said concave arms.

31. The apparatus according to claim 9, wherein each of said radiators comprises a hollow shell defining a planar support portion and a bulbous head segment.

* * * * *